United States Patent [19]

Close

[11] 4,339,912

[45] Jul. 20, 1982

[54] DEVICE FOR GRIPPING YARN SUPPORTS ON REVOLVING-SPINDLE TEXTILE MACHINES

[75] Inventor: Pierre Close, Modelheim, France

[73] Assignee: Societe Alsacienne de Constructions Mecaniques de Mulhouse, Mulhouse, France

[21] Appl. No.: 190,271

[22] Filed: Sep. 24, 1980

[30] Foreign Application Priority Data

Sep. 28, 1979 [FR] France ..... 79 24186

[51] Int. Cl.[3] ..... D01H 9/08

[52] U.S. Cl. ..... 57/275; 294/93

[58] Field of Search ..... 57/266, 267, 274, 275, 57/276; 294/92, 93

[56] References Cited

U.S. PATENT DOCUMENTS 2,962,856 12/1960 Ingham, Jr. ..... 57/275

3,813,866 6/1974 Goldammer et al. ..... 57/275

FOREIGN PATENT DOCUMENTS 2182870 12/1973 France .

*Primary Examiner*—John Petrakes

*Attorney, Agent, or Firm*—Cantor and Singer

[57] ABSTRACT

The gripping device consists of a holder in the form of an elastically deformable annular member mounted above the hole of a support plate at a single point of its lateral surface. The holder is provided with clamping means consisting of a flexible compressed-air tube also carried by the support plate at a point which is diametrically opposite to the point of attachment of the annular member. A guiding member in the form of an inverted funnel is attached to the support plate beneath the hole of the plate.

6 Claims, 9 Drawing Figures

FIG.1
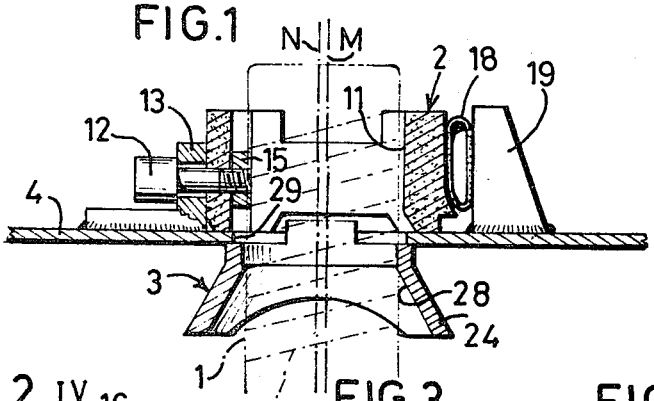
FIG.2
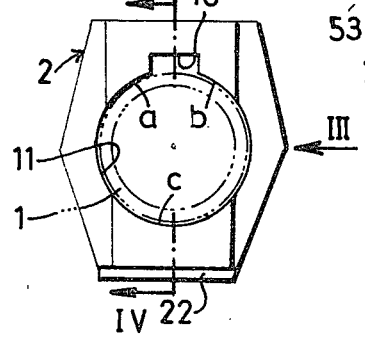
FIG.3
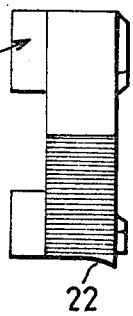
FIG.4
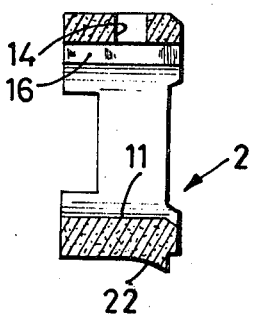
FIG.5
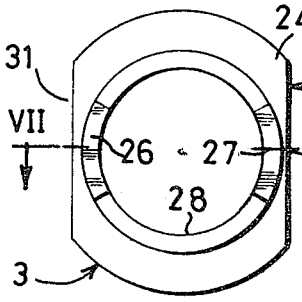
FIG.6
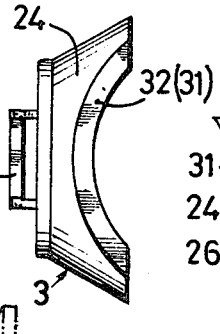
FIG.7
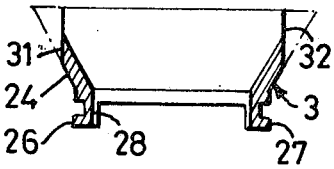
FIG.9
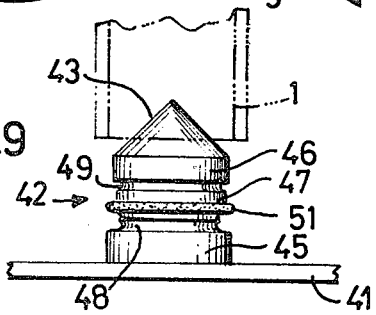
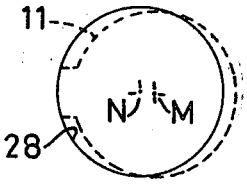
FIG.8

DEVICE FOR GRIPPING YARN SUPPORTS ON REVOLVING-SPINDLE TEXTILE MACHINES

This invention relates to gripping devices for the automatic doffing of yarn supports such as bobbins, tubes, cops or the like (generally designated hereinafter as "full bobbins" for the sake of simplicity) to be removed from spindles of textile machines such as ring spinning frames, twisting frames, roving frames and like machines as well as for placing the same empty supports (designated hereinafter as "empty bobbins") on the spindles of said machines.

Gripping devices are already known and one example of a device of this type has been described in French Pat. No. 2,182,870. This device comprises a movable supporting element on which are mounted on the one hand a holder constituted by a deformable annular member of flexible and elastic material which can be freely engaged on the bobbin and, on the other hand, means for controlling the clamping action of the holder by causing deformation of this latter in the radial direction. In one embodiment described in the patent cited above, the bobbin-holder is constituted by a thin elastic sleeve, the two ends of which are set in fluid-tight manner within the corresponding ends of a rigid tubular member which is rigidly fixed to the movable support. The means for controlling the clamping action of the bobbin-holder consist of a fluid under pressure which is directed into a gap formed between the elastic sleeve and the tubular member which carries said sleeve. However, one objection to this device lies in the fact that it has a complicated structure and is therefore costly to manufacture, especially on account of the difficulties encountered in order to ensure reliable fluid-tightness between the elastic sleeve and the tubular member within which said sleeve is fitted.

The aim of the invention is to provide a gripping device of the type aforesaid which is not subject to the disadvantages attached to the device described in the prior patent cited earlier.

To this end and in accordance with the invention, the movable supporting element is constituted by a support plate pierced by a hole providing a passageway for the upper end of a bobbin, the deformable annular member being adapted to rest on the peripheral edge portion of said hole and being fixed on said support plate at only one point of its lateral surface whilst means for controlling the clamping action of the bobbin-holder which are also mounted on said support plate are located opposite to a thrust zone of the lateral surface of the deformable annular member which is diametrically opposite to the fixing point aforesaid.

It is apparent that a device of this type has a very simple, economic and reliable structure. In order to produce the clamping action of the bobbin-holder, it is possible to employ any suitable control means which may be either mechanical, electromechanical, pneumatic, hydraulic and the like. In an advantageous embodiment, however, the control means consist of a section of flexible tubing interposed between the thrust zone of the deformable annular member and a bearing member fixed on the support plate, said flexible tube being adapted to be connected temporarily to a source of fluid under pressure, especially compressed air which is usually available on the type of textile machine under consideration for such purposes as cleaning.

These and other features of the invention will become apparent upon consideration of the following description and accompanying drawings in which one embodiment of the invention is shown by way of example, and in which:

FIG. 1 is a vertical sectional view of the bobbin-gripping device comprising a holder and bobbin guide;

FIG. 2 is a plan view of the bobbin-holder alone;

FIG. 3 is a profile view of the bobbin-holder, looking in the direction of the arrow III of FIG. 2;

FIG. 4 is a vertical sectional view taken along line IV—IV of FIG. 2;

FIG. 5 is a plan view of the bobbin guide alone;

FIG. 6 is a profile view of the guide, looking in the direction of the arrow VI of FIG. 5;

FIG. 7 is a vertical sectional view taken along line VII—VII of FIG. 5;

FIG. 8 is a schematic view showing the relative positions of the holder and the guide on their common support;

FIG. 9 shows the shape of a bobbin support mounted on a transporting device such as a conveyor belt.

The device for gripping a bobbin 1 as shown generally in FIG. 1 is essentially constituted by a bobbin holder 2 and by a bobbin guide 3 which are fixed on a support plate 4. Vertical and horizontal components of movements are applied to said support plate in order to carry out doffing of a full bobbin and replacement of this latter by an empty bobbin.

As illustrated separately in FIGS. 2 to 4, the bobbin-holder 2 consists of a block of flexible and elastic material in which is formed a bore 11 having a slightly larger diameter than the external diameter of the upper end of a bobbin 1 to be gripped, thus permitting the engagement of said holder on the upper end of the bobbin with substantial clearance. The bobbin-holder 2 is fixed on the top face of the support plate 4 (as also shown in FIG. 1) by means of a screw 12 which passes through the vertical arm of a right-angle bracket 13 as well as a radial hole 14 of the bobbin-holder and is screwed into a nut 15 which is flush-mounted in a channel 16 formed in the axial direction within the bore 11 of the holder. The right-angle bracket 13 is fixed by welding, for example, on the top face of the support plate 4. The holder 2 can be compressed radially towards the right-angle bracket 13 so as to clamp a bobbin 1 by means of a section of flexible but practically inextensible tubing 18 into which compressed air can be sent. This section of tubing is applied against a bearing member 19 which is also fixed by welding, for example, on the top face of the support plate 4. In the rest condition, the tube 18 has a flattened configuration as illustrated. Any other suitable means could be employed for compressing the bobbin-holder but the solution proposed is advantageous since compressed air is already available on textile machines of the type under consideration for such purposes as cleaning, for example. The face 22 of the bobbin-holder against which the tube 18 is applied is downwardly and outwardly inclined as shown in such a manner as to ensure that the thrust exerted by the tube in the inflated state tends to be downwardly oriented in order to maintain accurate centering of the bobbin.

The guide 3 which is shown separately in FIGS. 5 to 7 is designed in the form of a kind of inverted funnel of practically rigid material which is nevertheless slightly deformable in order that it may be fixed on the support plate 4 by means of two diametrically opposite claws 26, 27 which project outwards at the small end of the funnel. These two claws are formed in one piece with the funnel and are applied against the top face of the edge portion of a hole 29 formed in the support plate 4 (as also shown in FIG. 1). In addition, the funnel has two diametrically opposite flat lateral surfaces 31, 32 for the purpose of reducing the overall width of the funnel within the space provided between two successive bobbin spindles of the machine.

Referring now to FIG. 9, there will be described an improved device for supporting a bobbin on a transporting unit such as a conveyor belt 41. This support 42 of generally cylindrical shape is fixed on the conveyor belt 41 and terminates in a top portion 43 of conical shape. The cylindrical portion has a base 45 corresponding in diameter to the internal diameter of a bobbin 1, an upper portion 46 having a diameter which is preferably very slightly smaller than that of the base 45 in order to facilitate engagement of the bobbin, and an intermediate portion 47 having a slightly smaller diameter, two grooves 48, 49 being formed respectively in the two ends of said intermediate portion. A toric ring 51 of flexible and elastic material is fitted on the cylindrical intermediate portion 47 of the support 42 and the external diameter of said ring is very slightly larger than the internal diameter of the bobbin even when the ring is in position within either of the two grooves 48, 49.

The operation of the device is as follows:

By means of the support plate 4, the gripping device is brought into position above the bobbin 1 to be gripped, said bobbin being either full or empty. The gripping device is then moved downwards in such a manner as to engage around the upper portion of said bobbin 1. This downward movement takes place without any difficulty, first of all by virtue of the presence of the funnel-shaped guide 3 which corrects any possible defects of centering of the device with respect to the bobbin and, secondly, by virtue of the fact that the diameter of the holder 2 is slightly larger than the diameter of the upper portion of the bobbin 1. The next operation consists in admitting compressed air into the tube 18; as a result of deformation of the bobbin-holder, that portion "c" (FIG. 2) of the holder which is opposite to the channel 16 consequently moves towards the two portions "a" and "b" of the holder which are located immediately on each side of said channel. As a consequence, the upper portion of the bobbin is clamped by the holder in three zones which are substantially and angularly equidistant, namely under very good conditions. In order to remove the bobbin from the support on which it is at present located, that is to say either on a textile machine or a conveyor belt according as the bobbin is either full or empty, it is only necessary to lift the support plate 4; this latter is then moved in order to deposit the bobbin either on a discharge conveyor belt or on a textile machine support as the case may be. It is apparent that the tube 18 remains under pressure during this operation in order to ensure that the holder continues to clamp the bobbin. In order to release the bobbin, it is only necessary to allow the pressure within the tube to fall, thus enabling the holder to revert to its natural cylindrical shape with a clearance around the bobbin.

In order to facilitate engagement of the holder on the bobbin, the holder 2 has been mounted on the support plate 4 in a position in which it is displaced slightly off-center with respect to the guide 3 on the side opposite to the holder-fixing screw 12, as shown in FIG. 8. This figure shows at "M" the center of the bore 11 of the holder and at "N" the center of the bore 28 of the guide funnel 3. By virtue of this particular expedient, a bobbin is automatically re-centered if it is presented in an eccentric position with respect to the bore of the bobbin-holder. In fact, if the bobbin is presented in a position in which it is displaced towards the holder-fixing screw 12, the resistance set up by this latter has the effect of applying the bobbin against the above-mentioned bearing faces "a" and "b". On the contrary, if the bobbin is displaced off-center in the opposite direction, it comes into contact with the rigid edge of the funnel which returns it to the correct position within the holder. Failure to adopt this precautionary measure on assembly would have the following effect: when the bobbin comes into contact with the edge of the holder bore, the holder which is flexible and supported only by its screw 12 would be liable to lift and the bobbin would in turn be liable to escape from its holder.

When a bobbin and especially a full bobbin which is engaged by the gripping device is removed from the bobbin spindle and presented on the corresponding support 42 of the conveyor belt 41 (as shown in FIG. 9), the toric ring 51 which is at present located within the upper groove 59 of the support is displaced downwards by the lower end of the bobbin which covers the ring. Said ring then rolls onto the intermediate cylindrical portion 47 of the support until it drops into place within the lower groove 48. Thus the bobbin is suitably guided during the entire period of positioning on the support 42 and is perfectly centered on this latter. At the time of subsequent removal of the bobbin from the support 42, the toric ring 51 will be displaced upwards by the bobbin and, in a reverse movement, will roll from the lower groove 48 to the upper groove 49 in readiness for receiving a fresh bobbin.

Finally, when removing a full bobbin from the textile machine and breaking the yarn, it frequently happens that a more or less substantial length of yarn is unwound from the bobbin. In order to overcome this disadvantage, the formation of a yarn reserve at the upper ends of the full bobbins is programmed so as to ensure that, at the moment of doffing of a bobbin, said yarn reserve is gripped within the holder and the yarn is therefore not unwound from the bobbin at the instant of breakage. A few turns 53 of said yarn reserve are shown in chain-dotted lines in FIG. 1.

What is claimed is:

1. A device for gripping yarn supports such as bobbins, tubes, cops and the like whether full or empty on textile machines having revolving spindles for receiving supports of this type such as ring spinning frames, twisting fames, roving frames and like machines, comprising a movable supporting element on which are mounted (1) a holder comprising a deformable annular member of flexible and elastic material which can be freely engaged on the yarn support and (2) means for controlling the clamping action of the holder by causing deformation of said holder in the radial direction; wherein the movable supporting element comprises a support plate pierced by a hole providing a passageway for the upper end of a yarn support, said deformable annular member being adapted to rest on the peripheral edge portion of said hole and being fixed on said support plate at only one point of the lateral surface thereof whilst the clamping-action control means which is also mounted on said support plate is located opposite to a thrust zone of the lateral surface of the deformable annular member which is diametrically opposite to said one point.

2. A device according to claim 1, further comprising a bearing member fixed on the support plate, and wherein the clamping-action control means comprises a flexible tube section interposed between the thrust zone of the holder and the bearing member fixed on the support plate, said tube being adapted to be connected temporarily to a source of fluid under pressure.

3. A device according to claim 1 or 2, wherein a funnel-shaped guiding member formed of a material which is elastically deformable to a slight extent is fixed to the bottom face of the support plate, said guiding member being provided with claws which are capable of engaging on the edge of the hole of the support plate.

4. A device according to claim 1, wherein the geometrical axis of the guiding member is slightly displaced off-center with respect to the geometrical axis of the deformable annular member and towards the point of attachment of said member.

5. A device according to claim 1, wherein said device is adapted to cooperate with supports for receiving yarn supports constituted by cylindrical blocks each having a conical upper end and provided with a cylindrical intermediate portion of smaller diameter terminating in two grooves for alternately receiving a toric ring of flexible elastic material whose external diameter is slightly larger than the internal diameter of the end portion of the yarn support to be received.

6. A device according to claim 1, wherein the holder which engages with the full bobbins is adapted to grip at the same time a yarn reserve which is wound at the top portion of the bobbin at the end of the winding operation.

* * * * *